United States Patent [19]

Lenertz et al.

[11] Patent Number: 4,548,543

[45] Date of Patent: Oct. 22, 1985

[54] QUICK ATTACHMENT DEVICE

[75] Inventors: John B. Lenertz, Carver County; Carroll E. Moore, Sibley County, both of Minn.

[73] Assignee: Farmhand, Inc., Excelsior, Minn.

[21] Appl. No.: 709,039

[22] Filed: Mar. 7, 1985

Related U.S. Application Data

[63] Continuation of Ser. No. 605,157, Apr. 30, 1984, abandoned, which is a continuation of Ser. No. 327,244, Dec. 3, 1981, abandoned.

[51] Int. Cl.[4] ..... B66C 23/36

[52] U.S. Cl. ..... 414/686; 172/273; 403/379

[58] Field of Search ..... 414/686, 723; 403/379, 403/378; 172/272, 273, 274

[56] References Cited

U.S. PATENT DOCUMENTS

| | | | |
|---|---|---|---|
| 3,892,322 | 7/1975 | Drennhaus | 414/686 |
| 4,247,242 | 1/1981 | Goertzen | 414/686 |
| 4,264,264 | 4/1981 | McMillan et al. | 414/686 |

FOREIGN PATENT DOCUMENTS

| | | | |
|---|---|---|---|
| 1019695 | 10/1977 | Canada . | |
| 1024473 | 1/1978 | Canada . | |
| 1032901 | 6/1978 | Canada . | |
| 2549416 | 5/1976 | Fed. Rep. of Germany | 414/686 |
| 627074 | 8/1978 | U.S.S.R. | 414/723 |

*Primary Examiner*—Robert J. Spar
*Assistant Examiner*—Donald W. Underwood
*Attorney, Agent, or Firm*—Merchant, Gould, Smith, Edell, Welter & Schmidt

[57] ABSTRACT

A quick attachment device (12) for releasably connecting an implement (10) such as a loader to a vehicle without special tools comprises a pair of uprights (26) connected to the implement and a pair of corresponding pedestals (32) mounted on opposite sides of the vehicle. Each upright (26) is cradled by trunnions (40) in notches (38) on the corresponding pedestal (32) and releasably secured thereto by means of locking pins (48). Removal of the pins (48) and appropriate actuation of the cylinders (22, 30) causing the implement (10) to fulcrum about extendable stands (52) enable selective attachment or detachment from the vehicle.

6 Claims, 8 Drawing Figures

QUICK ATTACHMENT DEVICE

This is a continuation of application Ser. No. 605,157, filed Apr. 30, 1984, now abandoned, which is a continuation of application Ser. No. 327,244, filed Dec. 3, 1981, now abandoned.

TECHNICAL FIELD

The present invention relates generally to a mounting, and more particularly relates to an attachment device for facilitating quick connection or disconnection of a pivotal implement such as a front end loader to a tractor or the like.

BACKGROUND ART

Vehicles such as tractors often include powered material handling implements which are mounted directly thereon and controlled by the vehicle operator. The implement can be permanently mounted but this can restrict the vehicle to a single or limited purpose, and it is often more desirable to provide for selective attachment to maximize usage of the vehicle both with and without the implement. In addition to providing a connection between the implement and vehicle which must be both stable and secure, it is also desirable that any such attachment be convenient and easy to use.

Front end loaders traditionally have been pivoted to uprights welded or otherwise anchored to the sides of tractors, with the lift cylinders being coupled between the uprights or other structure on the tractors and the loader frame. Detachment and reattachment of loaders from such mountings has been difficult and time consuming, and has thus restricted utilization.

Selective attachment devices incorporating threaded, pinned and/or wedged arrangements have been available, however, the prior attachments have not been altogether satisfactory for one or more reasons. Many of these prior devices are connected by driving the vehicle into proper alignment and then mechanically engaging the vehicle and implement, but some devices are configured in a way that interferes with the operator's vision while maneuvering the vehicle into alignment, thus making mounting or dismounting difficult and time consuming. Another person is frequently required to let the vehicle operator know when proper alignment has been achieved. Some of the prior devices are unnecessarily complex and thus expensive, or require special tools and are thus inconvenient to use. Other problems have arisen from the particular orientation or attitude of the implement after disconnection.

U.S. Pat. No. 4,247,242 assigned to Farmhand, Inc. discloses a quick attachment device for a front end loader which overcomes some of these difficulties but still requires a wrench to effect connection and disconnection. In addition, the device in the U.S. Pat. No. 4,247,242 leaves the lift cylinders in extended condition after disconnection with the piston rods thereof exposed and subject to corrosion and, while the lift cylinders can be retracted after disconnection and extended before reconnection, this requires additional manipulative steps and time and therefore lessens convenience.

Recently issued U.S. Pat. No. 4,265,264 discloses a quick attachment device for a front end loader which requires no wrench or other tool to effect connection or disconnection. The initial and primary points of connection between the loader uprights and tractor pedestals in this device, however, are obscured from the operator's view such that guide and following surfaces and camming means must be employed to effect positive engagement. Moreover, the device in the U.S. Pat. No. 4,264,264 leaves the lift cylinders in extended condition with the piston rods thereof exposed and subject to corrosion, after dismounting the loader.

A need has thus developed for an improved quick attachment device of simplified construction whereby an implement such as a front end loader can be releasably connected to a tractor or other vehicle without additional tools, and which leaves the lift cylinders in retracted and protected positions upon disconnection.

SUMMARY OF INVENTION

The present invention comprises an improved quick attachment device which overcomes the foregoing and other difficulties associated with the prior art. In accordance with the invention, a pair of uprights connected to or comprising part of the frame of an implement are adapted for selective connection and disconnection with corresponding mounting pedestals on the vehicle. Each upright is supported for rocking or pivotal motion relative to the corresponding pedestal by means of a pair of trunnions which rest in aligned notches, serving as vertical locators, formed in the upper ends of the pedestals in clear view by the operator. Locking pins releasably secure the uprights to the pedestals, and the structural stops on the pedestals serve as horizontal locators and limit pivotal motion of the uprights to eliminate transverse loading on the locking pins whereby the pins can be inserted or withdrawn by hand without special tools.

The quick attachment device herein is particularly adapted for connecting a front end loader to a tractor by appropriate manipulation of the lift and tilt cylinders causing the loader to fulcrum about extendable stands carried thereby. The tilt and lift cylinders are left in retracted, protected positions upon dismounting without additinal manipulative steps.

BRIEF DESCRIPTION OF DRAWING

A better understanding of the invention can be had by reference to the following Detailed Description in conjunction with the accompanying Drawing, wherein.

DETAILED DESCRIPTION

Figures 1, 4:
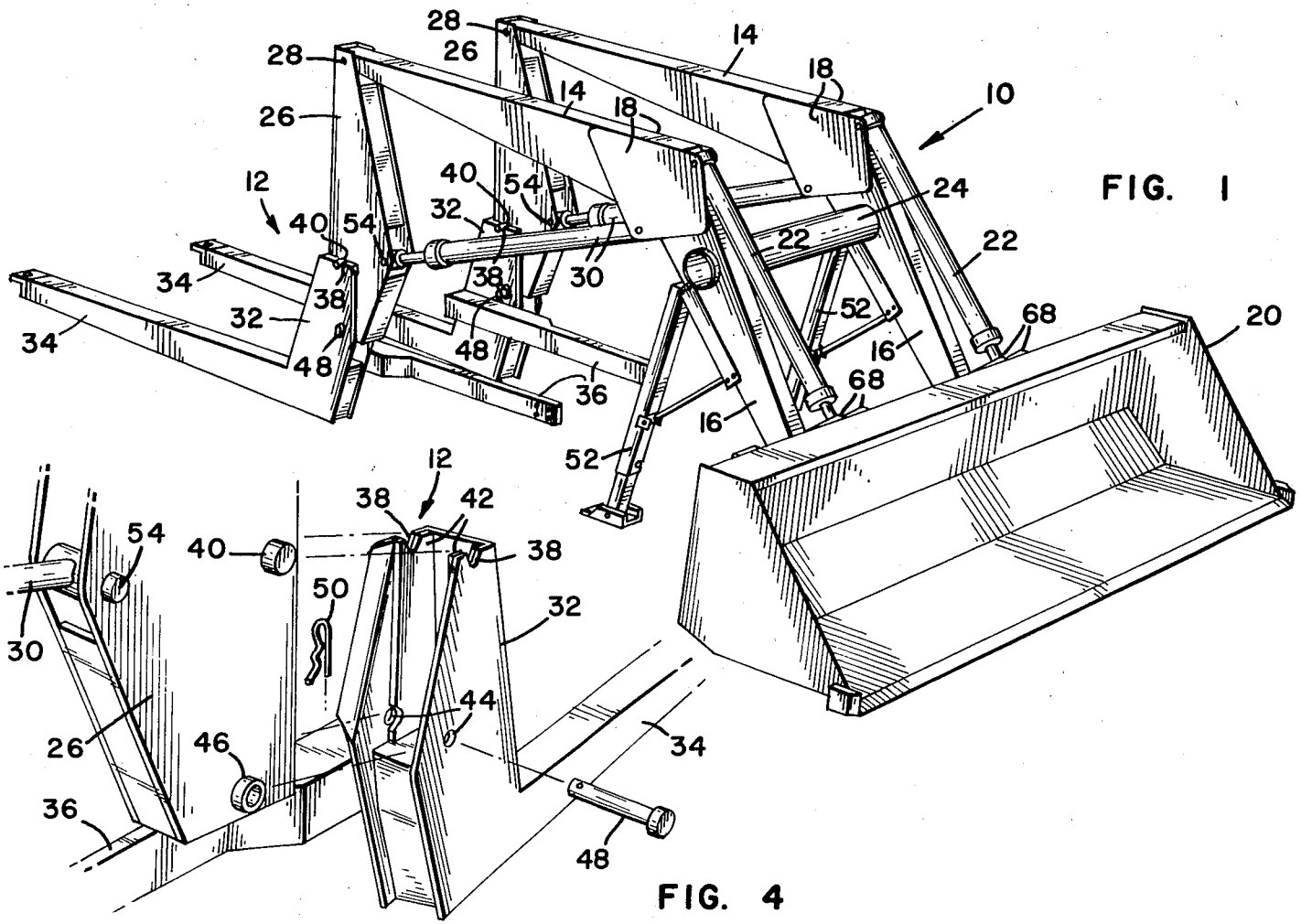
FIG. 1 is a perspective view of a front end loader incorporating the attachment device of the invention.
FIG. 4 is an enlarged partial perspective view upright on one side of the front end loader.

Referring now to the Drawing, wherein like reference numerals designate corresponding components throughout the views, and particularly referring to FIG. 1, there is shown a front end loader 10 incorporating the quick attachment device 12 of the invention. Loader 10 includes a pair of laterally spaced side frames comprised of inner or upper arms 14 and outer or lower arms 16 rigidly interconnected by plates 18. A bucket 20 is pivoted to the outer ends of the lower arms 16, and double acting cylinders 22 are coupled between the connecting plates 18 and the bucket for effecting selective tilting of the bucket. A cross brace 24 is secured between the lower arms 16 for rigidity and lateral stability during operation of loader 10. The inner or upper ends of upper arms 14 are connected to frame uprights 26 via pivots 28, and a second pair of double acting cylinders 30 are coupled between the uprights and connecting plates 18. Loader 10 thus includes several familiar components which cooperate in the well-known manner to permit independent lifting and tilting of the bucket 20.

Figure 2:
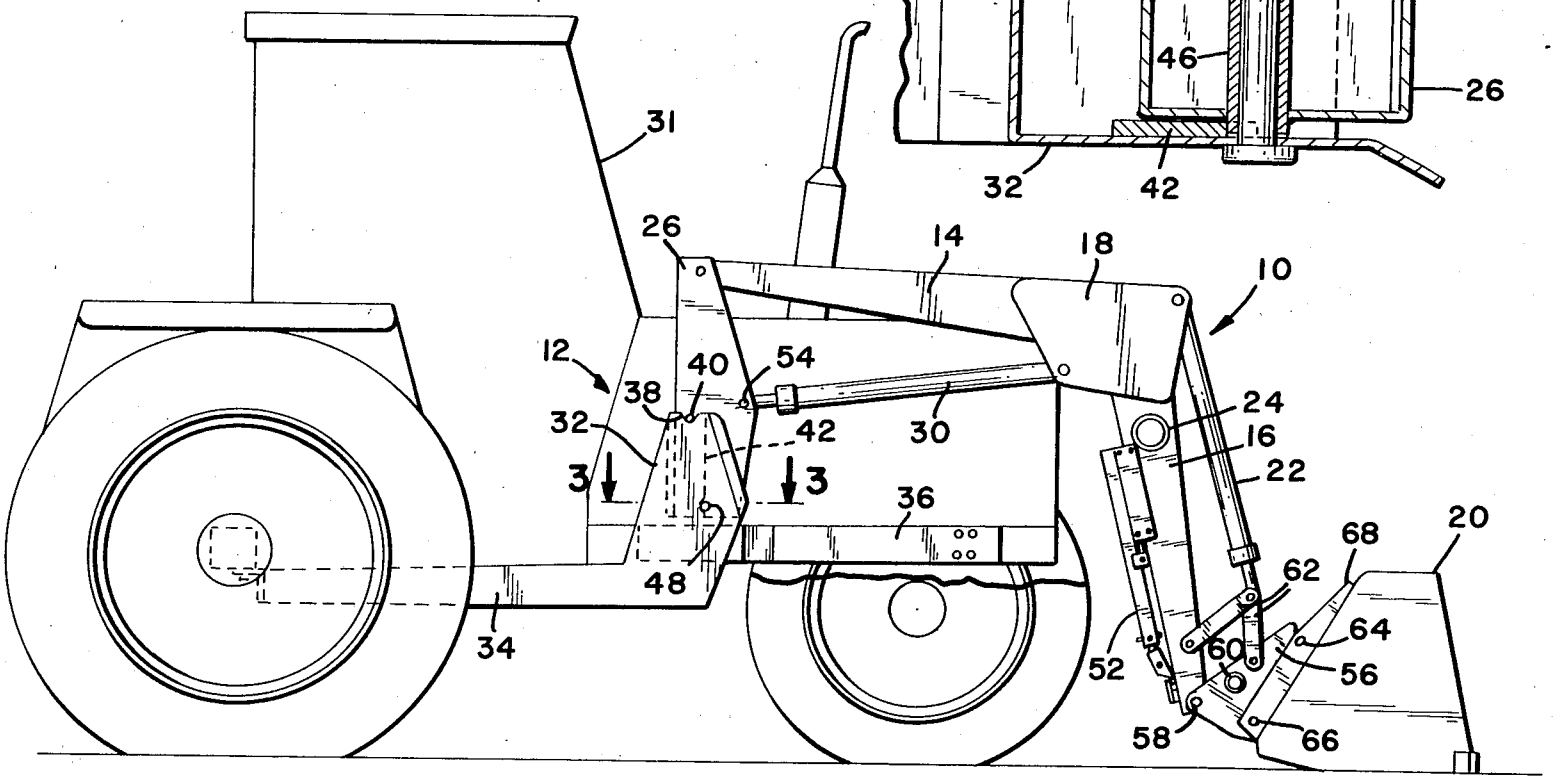
FIG. 2 is a side view of a tractor with the front end loader of FIG. 1 mounted thereon.

Referring now to FIGS. 1 and 2 together, the quick attachment device 12 permits selective connection and disconnection of the loader 10 to a vehicle such as the tractor 31 shown in FIG. 2. Although the quick attachment device 12 herein is particularly suited for attaching a front end loader to a tractor, it will be appreciated that the invention can readily be adapted for connecting sprayers, cultivators or other mechanisms to either end of a tractor or other vehicle. As will be explained in greater detail below, the quick attachment device 12 herein includes a pair of laterally spaced mounts or pedestals 32 secured to opposite sides of tractor 31 which receive uprights 26. As illustrated, each pedestal 32 includes longitudinally extending legs 34 and 36 adapted to be bolted, welded or otherwise fixed to the frame of the tractor 31 or other vehicle with which the front end loader 10 or other implement in question is being used.

Figure 3:
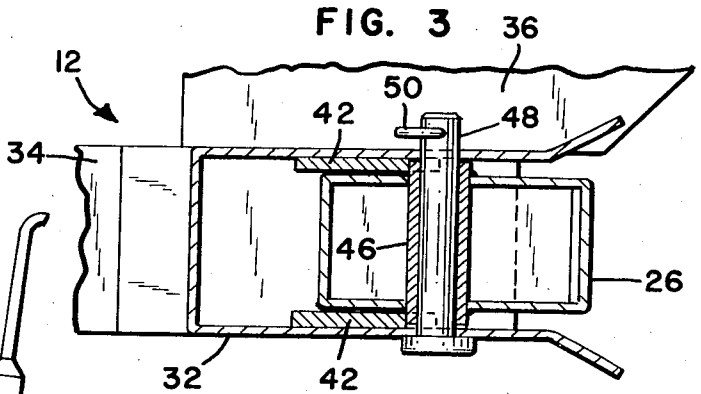
FIG. 3 is a sectional view taken along lines 3—3 of FIG. 2 in the direction of the arrows.

The structural details of the quick attachment device 12 are best seen in FIGS. 3 and 4. The uprights 26 can be generally box like or channel-shaped. Each pedestal 32 is of generally channel or U-shaped cross section opening upward and forward toward the loader 10, with the forward edges thereof preferably diverging outwardly to facilitate receipt of the corresponding frame upright 26 therein. Opposed notches 38 are formed in or near the upper end of each pedestal 32 thereby ensuring clear view by the operator, for pivotally receiving and cradling stub shafts or trunnions 40 extending outwardly from opposite sides of the corresponding frame upright 26. As illustrated, trunnions 40 are on uprights 26 while the corresponding receiving means or notches are on pedestals 32; however, those skilled in the art will appreciate that this order could be reversed, which reversal is considered fully equivalent to the illustrated arrangement.

Trunnions 40 define a generally transverse axis about which loader 10 can pivot during connection or disconnection. A pair of plates 42 are secured to the opposite inside surfaces of each pedestal 32 beneath notches 38 for reinforcement. Plates 42 extend downwardly from notches 38 behind aligned openings 44 formed in the pedestals 32, and are preferably notched as shown in FIG. 4 to surround the back halves of openings 44 in order also to function as stops and locators for the hollow collars or sleeves 46 extending through and protruding from the lower ends of the uprights 26. If desired, suitable stops could be provided on the inside surface of the webs of pedestals 32.

Notches 38 are thus adapted to receive and cradle trunnions 40, while openings 44 and the corresponding adjacent portions of plates 42 on pedestals 32 are adapted to receive and locate sleeves 46, after which locking pins 48 are inserted therethrough and secured with clips 50 to interconnect the uprights with the mounting pedestals. It will be apparent that, since locking pins 48 are below the points of vertical support, the weight of loader 10 normally biases the lower ends of uprights 26 solidly against the stop/reinforcement plates 42 so that collars 46 and openings 44 are aligned for receiving pins 48. The front end loader 10 is rockingly supported on pedestals 32 by trunnions 40 and notches 38, but is locked against motion relative to the mounting pedestals when pins 48 are in place. When loader 10 is in a raised position, portions of uprights 26, namely sleeves 46, are firmly engaged with stop plates 42 such that there are no transverse loads on pins 48 which would cause binding. Pins 48 can thus be inserted or withdrawn by hand without additional tools, to free frame uprights 26 for pivotal movement relative to pedestals 32 when mounting or dismounting loader 10.

Disconnection of the loader 10 from tractor 31 by means of the quick attachment device 12 herein proceeds as follows, having reference to FIGS. 5–8.

Figure 5:
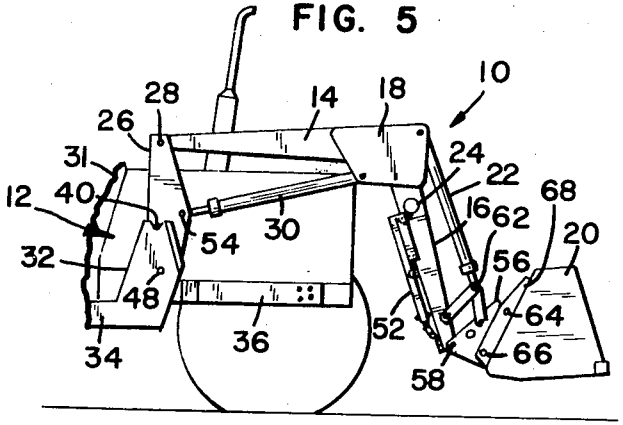

FIG. 5 shows loader 10 in a raised position off the ground entirely supported by the side mounting pedestals 32 on tractor 31. A pair of pivotal stands 52 are shown in their normal collapsed and secured positions mounted directly on lower arms 16 of loader 10. Stands of any suitable construction can be utilized, however, stands 52 are preferably constructed like the ones shown in U.S. Pat. No. 4,275,984 assigned to Farmhand, Inc., the disclosure of which patent is hereby incorporated by reference. Stands 52 function both as fulcrums and supports to facilitate connection and disconnection of loader 10.

Figure 6:
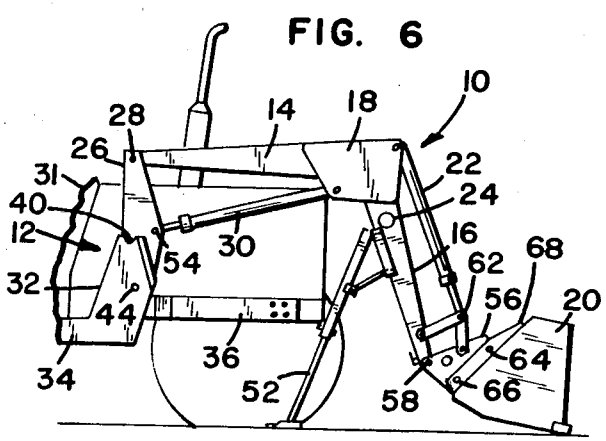
FIGS. 5-8 are partial schematic views illustrating connection and disconnection of a front end loader by means of the invention.

To disconnect loader 10, stands 52 are first released and then extended and pivoted backwardly. The tilt cylinders 22 are then extended to orient bucket 20 in a nose-down position, after which the bucket is lowered by retraction of lift cylinders 30 until the bottom lip of the bucket and the feet of stands 52 engage the ground as shown in FIG. 6. Pins 48 are then released and withdrawn from the openings 44 in mounting pedestals 32, thereby freeing loader 10 for pivotal movement as a unit about stands 52 and freeing uprights 26 thereof for pivotal movement with respect to pedestals 32.

Figure 7:
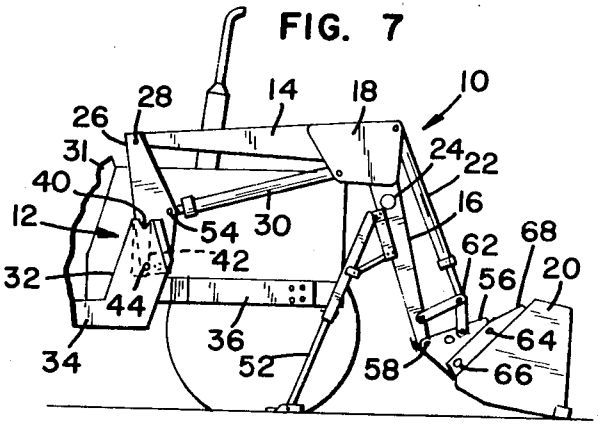

With loader 10 supported on stands 52 and the lower lip of bucket 20, lift cylinders 30 are then retracted causing uprights 26 to rock about trunnions 40 such that the lower ends of the uprights move forwardly away from plates 42 and the mounting pedestals 32 as shown in FIG. 7. This partially disengages uprights 26 of the loader 10 from mounting pedestals 32 such that the uprights are merely supported in an upward direction for rocking motion at the upper ends of the pedestals.

Figure 8:
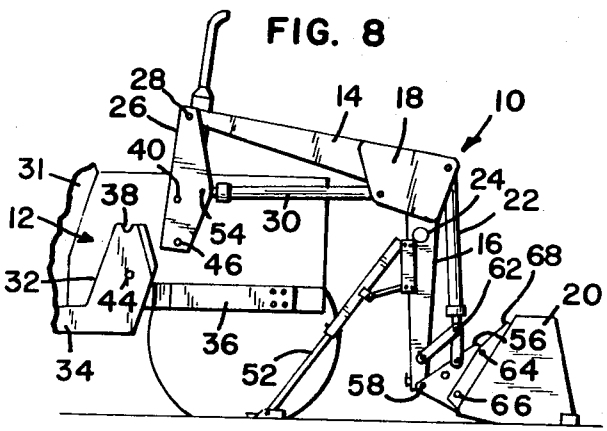

Tilt cylinders 22 are then retracted to rotate and lower bucket 20 from its lip on to its bottom surface, whereupon the entire loader 10 pivots about stands 52 and simultaneously lifts uprights 26 away from the mounting pedestals 32 as shown in FIG. 8 so that tractor 31 can be backed away. Typically, tractor 31 will be backed away only a short distance initially to permit disconnection of the various hydraulic lines (not shown) interconnecting the hydraulic pump (not shown) on the tractor with cylinders 22 and 30 on loader 10. It will be noted that the piston rods of tilt cylinders 22 and lift cylinders 30 on loader 10 are left in retracted, protected positions upon disconnection.

Loader 10 can be left resting upon its bucket 20 and stands 52 until reconnection of the loader with tractor 31 is desired, at which time the tractor 31 is driven back into position with mounting pedestals 32 located beneath uprights 26 before reversing this procedure to effect reconnection. Location of notches 38 at or near the upper ends of mounting pedestals 32 considerably facilitates the operator's task of maneuvering tractor 31 into proper alignment with the loader 10. All controls for loader 10 and for tractor 31 are preferably located inside the tractor cab such that it is only necessary for the operator to dismount when opening or closing stands 52, inserting or withdrawing pins 48, and connecting or disconnecting the hydraulic lines (not shown) between the vehicle and implement.

As illustrated, the connection points 54 at which 15 lift cylinders 30 are coupled to uprights 26 of loader 10 are located slightly above trunnions 40, however, it will be understood that such connection points can be located either above or below the levels of the trunnions. When connection points 54 are located above the level of trunnions 40 as shown, it may be desirable to power tractor 31 forward slightly as lift cylinders 30 are retracted in the step of FIG. 7 to prevent loader 10 and stands 52 from being pulled backwardly along the ground.

Referring now to FIG. 2, bucket 20 is pivoted the ends of outer arms 16, and is preferably adapted to facilitate quick connection and disconnection of the bucket to the frame of loader 10. In particular, a pair of carriers 56 are secured to the ends of lower arms 16 at pivots 58. Carriers 56 are interconnected by a cross piece 60 for rigidity and lateral stability. Tilt cylinders 22 are connected to carriers 56 by pairs of toggle links 62. Each carrier 56 includes upper and lower notches adapted to hook and engage corresponding steps 64 and 66 on brackets 68 attached to the backside of bucket 20 such that the bucket and loader 10 are positively interconnected.

From the foregoing, it will be apparent that the present invention comprises an improved quick attachment device having several advantages over the prior art. One advantage involves the fact that no tools are required either to disconnect or to reconnect the implement. The attachment herein features simplified, reliable construction. Another advantage stems from the fact that the lift and tilt cylinders of the implement, which in the illustrated embodiment comprises a front end loader, are retracted such that the piston rods thereof are not extended and thus exposed to corrosion or other damage. Other advantages will be evident to those skilled in the art.

Although particular embodiments of the invention have been illustrated in the accompanying Drawing and described in the foregoing Detailed Description, it will be understood that the invention is not limited to the embodiments disclosed, but is intended to embrace any alternatives, equivalents, modifications and/or rearrangements of elements falling within the scope of the invention as defined by the following claims.

We claim:

1. In an implement of the type including a frame, an upright connected at the upper end to the frame, and a fixed mounting pedestal adapted for connection to a vehicle, the improvement comprising:

a pair of aligned trunnions extending from opposite sides of said upright between the upper and lower ends thereof;

said pedestal being of generally channel-shaped cross section adapted to receive the lower end of the upright and having a pair of opposing aligned notches formed in the upper end thereof for supporting and vertically cradling said upright by said trunnions for pivotal movement about a transverse axis;

a stop on said pedestal, for limiting pivotal movement of said upright relative to said pedestal about the transverse axis, said upright when supported on said pedestal being normally gravitationally biased by the implement against said stop;

a sleeve extending through opposite sides of said upright between said trunnions and the lower end of said upright, said stop being positioned to engage said sleeve on said upright;

said pedestal including a pair of opposing aligned openings formed therein positioned for registry with said sleeve when said stop and upright are engaged; and a pin adapted for selective insertion through the openings in said pedestal and said sleeve for locking said upright in fixed position on said pedestal.

2. The implement of claim 1, wherein edge portions of said channel-shaped pedestal diverge outwardly to facilitate receipt of said upright therein.

3. The implement of claim 1, wherein the implement comprises a loader.

4. An implement adapted for selective attachment and detachment to the vehicle, which comprises:

a rigid frame;

at least one upright with upper and lower ends and pivoted at the upper end to one end of said frame;

a predetermined mechanism connected to the other end of said frame;

means for selectively pivoting said mechanism relative to said frame;

means for selectively pivoting said frame relative to said upright;

extendable stand means mounted on said frame for partially supporting the implement when detached;

a pair of aligned trunnions extending from opposite sides of said upright between the upper and lower ends thereof;

a pedestal secured to the vehicle, said pedestal being of generally channel-shaped cross section adapted to receive the lower end of said upright and having a pair of opposing aligned notches formed in the upper end thereof for vertically supporting and cradling said upright by said trunnions for pivotal movement about a transverse axis;

a stop located within said pedestal and engageable with the lower end of said upright for limiting pivotal movement of said upright relative to said pedestal about the transverse axis; said upright when supported on said pedestal being normally gravitationally biased by said frame and mechanism against said stop;

said upright and pedestal each including aligned openings therein adapted for alignment when said upright is engaged with said stop; and a pin adapted for selective insertion through the openings in said pedestal and upright for locking said upright in fixed position on said pedestal;

edge portions of said generally channel-shaped pedestal diverging outwardly to facilitate receipt of said upright therein, and wherein said stop comprises:

locating structure secured to said pedestal and positioned to engage protruding end portions of a sleeve defining the openings in said upright.

5. The implement of claim 4, wherein said mechanism comprises a bucket pivoted to said frame and the vehicle comprises a tractor.

6. In a front end loader having a frame, a pair of laterally spaced apart side members pivoted to one end of the frame, a bucket pivoted to the other end of the frame, means for selectively pivoting the frame relative to the side members, and means for selectively pivoting the bucket relative to the frame, apparatus for releasably attaching the loader to the vehicle comprising:

a pair of pedestals secured to the opposite sides of the vehicle, each pedestal being of generally channel-shaped cross section;

a pair of aligned trunnions extending from opposite sides of each side member between the upper and lower ends thereof;

a pair of pedestals secured to the vehicle, each pedestal being of generally channel-shaped cross section adapted to receive the lower end of said upright and having a pair of opposing aligned notches formed in the upper end thereof for vertically supporting and cradling said upright by said trunnions for pivotal movement about a transverse axis;

a stop located within each pedestal for limiting pivotal movement of said side members relative to said pedestals about the transverse axis, said side members when cradled on said pedestals being normally gravitationally biased by the loader against said stop;

each side member including a sleeve extending therethrough defining an opening adapted for registry with aligned openings formed in the corresponding pedestal, said aligned openings being located below the notches formed in the upper end of said pedestal, each stop being positioned to engage the sleeve of the associated side member;

a locking pin adapted for insertion through the openings in each pedestal and sleeve of the corresponding side member for selectively locking said side members to said pedestals in fixed position to secure the loader to the vehicle.

* * * * *